US005542022A

United States Patent [19]

Zauderer

[11] Patent Number: 5,542,022

[45] Date of Patent: Jul. 30, 1996

[54] COMPACT PACKED BED HEATER SYSTEM

[75] Inventor: Bert Zauderer, Merion Station, Pa.

[73] Assignee: Coal Tech Corp., Merion Station, Pa.

[21] Appl. No.: 85,761

[22] Filed: Jul. 1, 1993

[51] Int. Cl.[6] ..... F24H 1/00

[52] U.S. Cl. ..... 392/485; 392/341; 392/346; 165/104.16; 432/215

[58] Field of Search ..... 392/485, 341, 392/346, 386, 487–489; 310/11; 165/104.16; 122/367.4; 60/203.1; 422/199, 211; 432/215

[56] References Cited

U.S. PATENT DOCUMENTS

| | | | |
|---|---|---|---|
| 2,235,401 | 3/1941 | Gier, Jr. | 392/485 |
| 2,670,426 | 2/1954 | Stone | 392/485 |
| 3,497,674 | 2/1970 | Zirngibl et al. | 392/485 |
| 3,768,552 | 10/1973 | Ciraud | 432/215 |
| 3,846,616 | 11/1974 | Beck | 392/487 |
| 4,608,627 | 8/1986 | Holt | 310/11 |
| 4,617,483 | 10/1986 | Marks | 310/11 |
| 4,851,722 | 7/1989 | Zauderer | 310/11 |
| 5,010,255 | 4/1991 | Hilal et al. | 310/11 |
| 5,086,234 | 2/1992 | Shiota et al. | 310/11 |
| 5,165,861 | 11/1992 | Jahns et al. | 310/11 |

FOREIGN PATENT DOCUMENTS

| | | | |
|---|---|---|---|
| 604196 | 4/1978 | U.S.S.R. | 392/485 |

OTHER PUBLICATIONS

Kerrebrock et al, "A Large Non–equilibrium MHD Generator", Proc. of Symposium of Intl Atomic Energy Comm., 4–8 Jul. 1966..pp. 567–581.

Cook, C. S., "Current Experimental Results From Operation of the GE Closed Cycle Ceramic Regenerative Heat Exchanger", Proc. of 15th Symposium, Engr. Aspects of Magnetohydrodynamics, Phila, PA, 24–26 May 1976.

Zauderer et al, "Experiments in a Large, Non–equilibrium MHD Generator With Cesium Seeded, Noble Gases and Heated Electrodes", Fifth Intl Conference on Magnetohydrodynamic Elec. Power Generation, Munich, 19–23 Apr. 1971.

Zauderer et al, "Initial Experiments of a Chemically Heated, Non–equilibrium MHD Generator", Proc. of 28th Symposium, Engr. Aspects of Magnetohydrodynamics, 26–28 Jun. 1990, Chicago IL.

Balemans et al, "High Enthalpy Extraction Experiments With the Eindhoven Blow–down Facility", 9th Intl Conf. of Magnetohydrodynamic Electrical Power Generation, V. 2, 17–21 Nov. 1986.

Petrick et al, "Open Cycle Magnetohydrodynamic Electrical Power Generation", Chap. 9., Argonne Natl Lab, Argonne IL, 1978.

Heywood et al, "Open Cycle MHD Power Generation", Chapter 3, Pergamon Press, London, 1969.

*Primary Examiner*—John A. Jeffery

[57] ABSTRACT

A compact portable apparatus and method for heating gases for periods ranging from about one tenths of a second to several minutes to temperatures as high as 2700° Celsius in 4 hrs. Graphite or metal oxide spherical pebbles which are placed in an externally thermally insulated cylindrical bed. The pebbles enclose and are heated by electrical resistive elements from which they are physically isolated. High heat storage density is achieved by designing the bed for high pressure loss operation and gas flow is in the downward direction. The bed is pressurized prior to initiating the gas flow with a quick acting valve or burst disc placed at the heater outlet. Typical applications are as a heat source for magnetohydrodynamic channels or wind tunnels. For magnetohydrodynamic applications a pulsed liquid seed metal injection method producing micrometer diameter liquid particles is disclosed. The spent gas leaving the channel passes through a seed metal condenser and gas cooler, and enters an inflatable balloon which captures the gas for subsequent reuse. The invention discloses critical design features that allow a compact, portable and reliable system.

17 Claims, 8 Drawing Sheets

COMPACT PACKED BED HEATER SYSTEM

BACKGROUND OF THE INVENTION

1. Technical Field

The present invention relates, in general, to packed bed heat exchangers and, in particular to a system and method for their use as a compact heat source for short duration hot gas flow applications.

2. Background Art

The packed bed, regenerative heat exchanger has been in use for over a century and its heat transfer and fluid flow characteristics are well defined, For a bed with spherical pebbles, the pressure drop is given by $$\text{Delta } P=f(L*G^2/D_p*Rho)$$

where L is the length of the bed, G is the mass flow rate per unit cross-sectional area of the bed without the pebbles, $D_p$ is the diameter of the pebbles, and Rho is the average gas density in the bed.

These heater have been used in commercial applications in the metals industry for heating air for iron smelting. These heaters consist of cylindrical steel vessels, about 50 to 100 feet high, which contain a cylindrical stack of cored ceramic bricks, (instead of ceramic spheres), surrounded by a low thermal conductivity cylindrical insulating layer. Gas combustion products at temperatures of up to 1650 Celsius pass through the nominal ½ inch diameter cored passages from the top to the bottom of the heater. After a period of several tens of minutes, the combustion gas flow is shut off by closing a valve, and cold air is forced upward through the passages in order to heat the air to near 1650 Celsius. Three to four of these heaters are cycled sequentially in order to yield a nearly constant flow of hot air from these heaters.

In the 1960's extensive R&D began on the development of high temperature magnetohydrodynamic (MHD) power generation systems. Thermodynamically MHD power systems are identical to gas turbine Brayton power cycles in which the MHD generator replaces the gas turbine-generator part of the cycle. Power is produced when a high temperature electrically conductive gas passes through a transverse magnetic field. By Faraday's law of electromagnetic induction, an induced electric field is produced in the gas and power can be drawn by means of electrodes inserted orthogonally to the magnetic field and gas velocity vectors on opposing walls of the MHD generator channel. To render the gas electrically conduction, it is necessary to heat it to the range of 2000K to 3000K. At the lower temperatures, the induced magnetic field can enhance the gas electrical conductivity to above its equilibrium value based on the gas temperature. This process is practical only in the noble gases, such as helium or argon, and in diatomic gases with homopolar molecules, such as hydrogen and nitrogen. Concentrations of other molecular gases above the range of several tenth's of one percent will quench this non-equilibrium conductivity effect. Therefore, a means of indirectly heating these gases to the 2000K range must be used, and ceramic cored brick or ceramic spherical pebble bed heaters have been used since the early 1960's. For research purposes, these heaters were sometimes heated with electrical elements placed in the bed matrix. In addition, some researchers used graphite as the packed bed material due to its higher thermal storage capacity. (. R. Decker, M. A. Hoffman, & J. L. Kerrebrock, "Behavior of a Large Non-Equilibrium MHD Generator", AIAA J., Vol. 9. No. 3, March 1971, pp. 357–264) ("Ref. 1"). Others used ceramic pebbles or ceramic cored bricks as the heat storage elements. In addition, combustion gases were used to heat the bed to operating temperature, at which time combustion ceased, the bed was evacuated and the MHD test gas, argon or helium, was blown upward through the bed for periods of about 1 minute. (C. S. Cook,, "Current Experimental Results from Operation of the GE Closed Cycle Ceramic Regenerative Heat Exchanger", *Proceedings 15th Symposium on Engineering Aspects of MHD,* U. of Pennsylvania, Philadelphia, Pa., May 24–26, 1976, p. VII.4) ("Ref. 2"). In the latter case, the objective of the test was to evaluate the operation of the heat exchanger for future design in a commercial MHD system. For this purpose, a temperature profile increasing from several 100 C. at the bottom of the bed to 1725 C. at the top of the bed was produced by the combustion gas. This temperature profile assures most efficient heat transfer from the combustion gas to the bed and then to the argon gas. The combustion gas entered the bed on top and exited at the bottom. The MHD test gas, argon, entered the bed at the bottom and exited at the top toward a simulated MHD channel. The period of constant heated gas temperature output is determined by the region at the top of the bed that has been heated to the peak temperature. In other words, if, for example, the top one foot height of the bed was heated to 1725 C. and the remaining bed height has a gradually decreasing temperature profile, the argon gas outlet temperature would remain constant until the thermal cooling wave due to the argon has reached the bottom of the 1 foot section at the top of the bed. The maximum time of the constant temperature gas pulse is determined by the thermal energy stored at constant temperature, namely 1725 C., in the solid bed material, which in this example is 1 foot. A longer duration constant temperature gas pulse from a heater having the same diameter bed requires a longer section of solid bed material at constant temperature. Conversely, a shorter constant temperature gas pulse requires less bed material. In other words, the maximum time of the constant temperature gas pulse is determined by the mass of solid material at the peak temperature in the bed. This relationship of maximum constant temperature pulse length to quantity of bed material is well known to designers of storage heat exchangers. It is thus obvious that to achieve a constant temperature for a long time period in this mode of operation, an extremely high bed height is required. This is especially the case when the added restriction of a low gas pressure drop is added to the bed design criteria, as discussed below.

The plasma physics and fluid mechanics of MHD generators are described in a numerous books. The ceramic heaters are also described in a number of texts.

It is well known that for high thermodynamic efficiency in a gas Brayton cycle, the gas pressure losses must be minimized. This dictates the use of very large packed bed heater exchangers, irrespective of the use of ceramic cored bricks or spherical pebbles. In Cook's packed bed, cored brick ceramic heat exchanger, a thermal output of only 3000 kW (thermal) for a 1 minute blowdown in argon at 10 atmospheres pressure, required a central core of about 16 inches in diameter and 10 feet high. This core, weighing over 1 ton, was surrounded by a thick ceramic insulating layer sufficient to maintain the steel shell as a safe temperature. The height of the bed and its gas passages cross-section are also dictated by the need to prevent the high pressure argon flowing in the upward direction from fluidizing the upper ceramic cricks or pebbles.

Due to the massive size of these beds, whether of graphite or ceramic, (e.g. alumina), they were used primarily for tens of a second to one minute duration high pressure blowdown purposes, and with the objective of simulating as closely as possible, an actual commercial MHD power generation cycle. As noted, all researchers forced the test gas to flow in the upward direction, which meant that a relatively low, (less than 10%) pressure drop was required to prevent fluidization of the bed. This also dictated a large gas passage cross-section in the packed bed.

Additional background art relating to the present invention is the use of shock tubes and shock tunnels to provide the high gas temperature flowing gas for MHD channel testing and wind tunnel testing. Due to the relatively high cost of conducting experiments that required very high temperature flowing gas sources, such as in non-equilibrium MHD generator research, shock tubes and shock tunnels were used. The shock tube provides a hot (2000 to 10,000 C.) gas source for periods of several 100 microseconds in the noble gases of interest in MHD power, (B. Zauderer, "Shock Tube Studies of Magnetically Induced Ionization", Phys. Fluids, Vol. 7, pp 147–9,{1964}) ("Ref. 3"). To increase the hot gas flow time to the range of 10 milliseconds, a shock tunnel was used in which the shock heated gas, after traveling down a long pipe was reflected from the downstream end of this pipe, bringing the high velocity gas to essentially stagnation gas conditions. A small nozzle placed in the end wall of the shock tube allowed outflow of the gas into the test channel, such as the MHD generator, for periods of up to 10 milliseconds. (B. Zauderer & E. Tate, "Performance of a Large Scale Non-Equilibrium MHD Generator", AIAA J., Vol. 9, No. 6, June 1971, pp. 1136–1143) ("Ref. 4"). These devices allow the performance of multiple tests per day at relatively very low operating costs. However, they have a relatively high first cost, and they occupy considerable space. For examples, in Ref. 4, a 10,000 kw thermal power, 10 millisecond duration, 1700 C. to 4000 C. argon and/or neon gas shock tunnel that was used for non-equilibrium MHD generator research, had an overall length of nearly 80 feet. The shock tube section was 1 foot in diameter and 50 feet long. Clearly these devices are very costly research tools and they have no potential for commercial applications as portable pulsed power sources. In addition, their limited test time eliminates them as a suitable source for study of hot gas-MHD generator wall thermal phenomena. Also, these devices are not suitable for testing low molecular weight gases such as helium or hydrogen, which are of major interest for non-equilibrium MHD application because their low molecular weight assures a very high power density in the MHD generator.

Additional background art relating to the present invention is the use of a metal fuel-oxidizer combustion heat source for MHD and wind tunnel applications. Zauderer has patented this system (B. Zauderer, Magnetohydrodynamic System and Method, U.S. Pat. No. 4,851,722, Issued Jul. 25, 1989) (Ref. 5). By using the liquid and solid products of metal-oxygen reaction to directly heat the MHD gas, such as helium or hydrogen, in the metal fuel combustion chamber, a very compact high energy density heat source is obtained for use in MHD generator and wind tunnel applications. Operation continues as long as the fuel feed is maintained. Due to ignition startup considerations, a practical lower limit for this device is a little under 1 second. Operation for periods in excess of a few seconds requires continuous removal of the metal oxide products of combustion in liquid form, as disclosed in Ref. 5. To provide a basis for comparison with the above packed bed heater size, a 10,000 kw thermal combustion chamber is about 6 inches in diameter and about 1 foot long. This compares with the 50 foot long shock tube, and the I ton, 10 foot high packed bed heater. Also, the oxygen and MHD test gas can be stored at high pressure (2,500 to 10,000 psi) to minimize storage volume.

A variation of this approach suitable for periods of 0.1 second duration is to use solid fuel-oxidizer pellets which can be chemically bound with hydrogen and the alkali metal seed, as the hot MHD gas heat source. Examples of such fuels are metal hydrides, such as zirconium hydride, and oxidizers such as ammonium nitrate. This heat source was tested for non-equilibrium MHD applications and is described in B. Zauderer, F. Rodgers, B. Borck, "Initial Experiments on a Chemically Heated Non Equilibrium MHD Generator", Proceedings 28th SEAM MHD Symposium, Chicago, Ill., Jun. 28, 1990, Chicago, Ill., Jun. 28, 1990). ("Ref. 6") A major disadvantage of these metal fuel heat source systems is safety considerations. Due to the danger of accidental explosions of the fuel oxidizer, the operation must be conducted under safety conditions suitable for explosion hazards, which substantially adds to the operating costs for test and commercial applications.

Additional background art relating to the present invention is the injection of the alkali metal seed into the hot MHD test gas stream. For multi-second and longer test periods, the alkali metal is injected through a positive displacement syringe either directly into the hot gas stream through various types of atomizers (W. J. M. Balements & R. H. Th. Rietjens "High Enthalpy Extraction Experiments with the Eindhoven Blowdown Facility" Proc. 9th Int.MHD Symposium, Tsukuba. Ibaraki, Japan, Nov. 17–21, 1986, Vol. II, pp. 330–340), ("Ref. 7"), or the liquid stream is injected into a chamber in which the alkali liquid is vaporized in a chamber and mixed with a small quantity of MHD test gas, (e.g. helium) and expanded into the main hot gas stream (M. Ishimura, et. al., "Engineering for Experiments of the Fuji-1 Facility", Proc. 9th Int.MHD Symposium, Tsukuba. Ibaraki, Japan, Nov. 17–21, 1986, Vol. H, pp. 351–358) ("Ref. 8"). The critical deficiency with these injection schemes is that in their reported form they are unsuitable for short duration tests of one second or less duration.

SUMMARY OF THE INVENTION

The present invention is designed to minimize the size of the packed bed heater system in order to allow its repetitive use as a portable, pulsed, low cost heat source. The invention discloses a method whereby this heater can be used for MHD or wind tunnel tests ranging from several tenths of a second several minutes. In the embodiment of this invention that was first reduced to practice, the system consisted of a high pressure helium or nitrogen gas storage cylinder, an electrically controlled solenoid valve, pipes that connected the gas cylinder to the top of the pebble bed steel containment vessel, a burst disc at the bottom outlet of the vessel, and a duct that connected the heater to the test article, in this case an non-equilibrium MHD generator. A liquid cesium filled syringe was placed immediately downstream of the burst disc. Prior to electrically heating the bed for a period of several hours, the heater vessel was evacuated, and a solenoid valve was briefly opened to fill the heater vessel to a pressure slightly below the burst pressure of the burst disc. After completion of heatup, the solenoid valve was reopened and allowed to remain open until the disc burst. A pressure transducer detected the flow of gas downstream of the burst disc and sent a signal to a computer which triggered the magnet used in the MHD generator. It also triggered a small quick acting solenoid valve which allowed high pressure gas to drive the plunger in the cesium syringe and force the liquid out of a needle into a commercial liquid atomization assembly. The latter injected a mist of cesium with droplets in the 10's of micrometer size into the hot gas stream. Within a few tenths of a second the solenoid valve on top of the gas cylinder was closed and the test was complete.

To practice this invention several critical modifications to the design and operation of the heater are made which differ from that practiced in prior art. This results in a packed bed heater with the following descriptive specifications.

Spherical particles, or pebbles, are used as the bed heat storage medium, instead of cored bricks. This very substantially increases the surface area in the bed per unit length in the gas flow direction, which in turn results in a higher rate of heat transfer to and from the gas.

The preferred pebble material is graphite. It resists thermal shock, and it has a higher heat capacity, and a lower density, and higher operating temperature than ceramic pebbles. It is suitable for use with noble gases to 3000 C., and with hydrogen and nitrogen to nearly as high temperatures. Nevertheless, the invention can also be practiced with ceramic pebbles if dictated by the specific application.

The pebbles are placed in a capped cylindrical vessel made of graphite (or ceramic, if necessary). One or more graphite tubes penetrate the pebble bed to be used for insertion of graphite or tungsten electric heating elements. These elements are powered by an impedance matched power supply which gradually heats the vessel between hot gas blowdown tests. Heat up times can range from tens of minutes to several hours. The cylindrical vessel containing the pebbles is thermally insulated from the steel pressure vessel containing the bed with a woven graphite fiber or ceramic low conductivity blanket type material Another important step in minimizing the bed size in this invention is to design it for a substantially higher pressure drop than was the practice disclosed in prior art. In the bed design first described in a public meeting by the applicant, ("B. Zauderer and B. Borck, "Pulsed Non-Equilibrium MHD Power Generation Using a Thermal Energy Source", Proc. of the 30th Symposium on Engineering Aspects of MHD, Baltimore, Md., Jun. 30, 1992, p. III.4.1) ("Ref. 9"), the bed was designed for a 20% pressure drop. This is more than double the design pressure drop used in heaters disclosed in prior art. Even higher pressure drops can be specified within structural limitations of the containment vessel. To prevent fluidization of the pebbles in this embodiment of the invention it is essential that the test gas flows downward in the direction of gravity through the heater instead of the upward direction used in prior art.

Also to minimize the bed size it is necessary to operate the test gas at high stagnation pressure, typically 10 to 50 atmospheres. This can result in structural failure of the pebble containment vessel if the gas is suddenly introduced into the heater vessel. To prevent this, a burst disc or very quick acting valve, depending on the total hot gas pulse length desired, is placed underneath the heater in the gas outlet pipe. Prior to the beginning of the 1 to 2 hour bed heatup cycle, the bed is evacuated and then filled to below the disc burst pressure. The remaining pressure difference between the higher burst disc break pressure and the lower pre-fill gas pressure is less than the design pressure drop across the bed when the test gas is flowing. Therefore, the graphite or ceramic pebble containment vessel need only be designed to contain the pressure difference between the gas flowing at the bottom of the pebbles inside the graphite vessel and the gas filling the insulating material void outside the graphite vessel.

Another important element in minimizing the bed size is that the entire bed of pebbles is heated to the desired peak operating temperature. This eliminates the extensive lower section that is used in prior art systems to maximize efficiency and to minimize thermal shock damage to ceramic materials. The required bed size is determined from the total desired heat storage. For example, if an MHD power output of 1 megawatt (MWe) is desired, and a minimum 10% heat to electric conversion efficiency is anticipated, the thermal power in the gas must be 10 MWe. Therefore, for a 0.1 second power pulse, the energy transferred from the bed to the gas must 1 megajoules (MJ). To assure that the gas temperature remains within 10% of its initial peak value, a little over 1 MJ of energy must be stored in the bed in a temperature range between the initial and final bed temperature. For example, for a temperature range between 2000 and 1800 C. in the gas blowdown pulse, the pebble mass must equal to 1 MJ divided by 200 times the pebble specific heat. To assure that the pebble's total surface area is adequate to transfer the heat from the pebbles to the gas, one computes the heat transfer coefficient from the following relation $$Nu=f(Rey, Pr) \quad (2)$$

where Nu is the Nusselt number, Rey the Reynolds number, and Pr the Prandtl number. For pressures greater than 10 atmospheres the heat transfer coefficient is not a limiting design parameter. For a longer duration pulse (>0.2 sec.) a computer solution is needed in order to minimize the bed size. For the above 1 MJ energy transfer example, it was determined that a bed consisting of 0.25" D. graphite pebbles placed in a graphite vessel of 3.25" ID, 4.25" OD, and 10 in L. dimension will provide the necessary heat storage.

The advantage of graphite is its relatively high specific heat and its use at temperatures of up to 2730 C. This is beyond the capacity of metal oxides. The disadvantage of graphite is that it is an electrical conductor. As an electric resistance heater is used to heat the bed, great care must be taken to prevent internal shorting. In reducing this invention to practice, tungsten wires and rods and graphite rods were used as heating elements. The preferred embodiment is a single graphite rod connected to a electrical feed through on top of the heater and inserted into a graphite cylinder running the entire length of the bed. The bottom end of the bed is allowed to contact electrical ground and serve as the electrical return path of the circuit. In case two heating elements are needed for impedance matching, the bed serves as the voltage midpoint for each of the two elements which are connected to a separate electrical feed through to the transformer secondary leads.

Another element of this invention is the insulating material. For a graphite heater, the most effective thermal insulating material between the bed and the steel shell is carbon powder. However, in reducing this invention to practice it was observed that sufficient carbon powder was entrained with the gas flowing through the heater as to sharply reduce the gas flow velocity out of the heater. This entrainment was caused by suction due to the lower gas pressure inside the pebble heater vessel and the insulator section. Leakage between the two sections is unavoidable and entrained carbon particles act as a drag on gas flow. To control this problem the use of woven carbon fiber or ceramic felt material is disclosed. This material was tested and found to reduce the entrainment problem to negligible proportions and its use is a critical element in practicing this invention.

For MHD applications, alkali metal seed must be injected into the hot gas stream exiting from the packed bed heater. For very short gas pulses of several tenths of a second duration, the alkali metal, such as cesium, must be injected in micrometer size droplets in order to vaporize and mix in a small pulsed MHD system, such as the 1 MW electric output, 0.1 second duration pulse used in this descriptive example. In reducing this cesium injection system to practice, it was found that a gas atomizing pressure spray unit supplied by Spraying Systems Co. Model No. 1/4 JN-SU22-provided sufficiently small droplets of about 35 micrometer nominal diameter to vaporize the cesium in the 1 to 2 millisecond gas flow time from the heater to the MHD generator. The vaporization time is computed by a heat balance between the hot gas to the cesium droplet and the cesium heat of vaporization. A Nusselt number of 2 is used to compute the gas heating of the droplet. The operation of the atomizer will be described after the listing of figures.

Another critical element in practicing this invention is the use of a computer to control all the steps in the operation of the pulsed heater. This operation will be described in the detailed description of the invention.

For multiple pulse applications it is desirable to capture the test gas and seed for future reuse and to prevent the possibility of unfavorable environmental intrusions. Therefore, after the gas exits the MHD channel, it passes through a compact externally finned tube heat exchanger which cools the test gas, such as helium, to the point where the alkali metal, such as cesium, condenses on the tubes and flows down to a a cesium collecting pot for future reuse. The external surface area of the finned tubes is designed to provide sufficient cooling of the helium to the cesium condensing temperature. The gas then enters a deflated balloon and which is sized to inflate to the point where all the helium gas fills a volume sufficient to produce about one atmosphere pressure in the balloon. These balloons are commercially available in sufficient size to contain the helium flow for a 10 second pulse 15 MW MHD generator. Alternatively, if gas recovery is not required, the exit gas can pass a water spare atomizer and then enter a large filter bag which will capture the spent alkali metal hydroxide seed.

BRIEF DESCRIPTION OF THE DRAWINGS

Referring to the drawings.

DETAILED DESCRIPTION OF THE INVENTION

Figure 1:
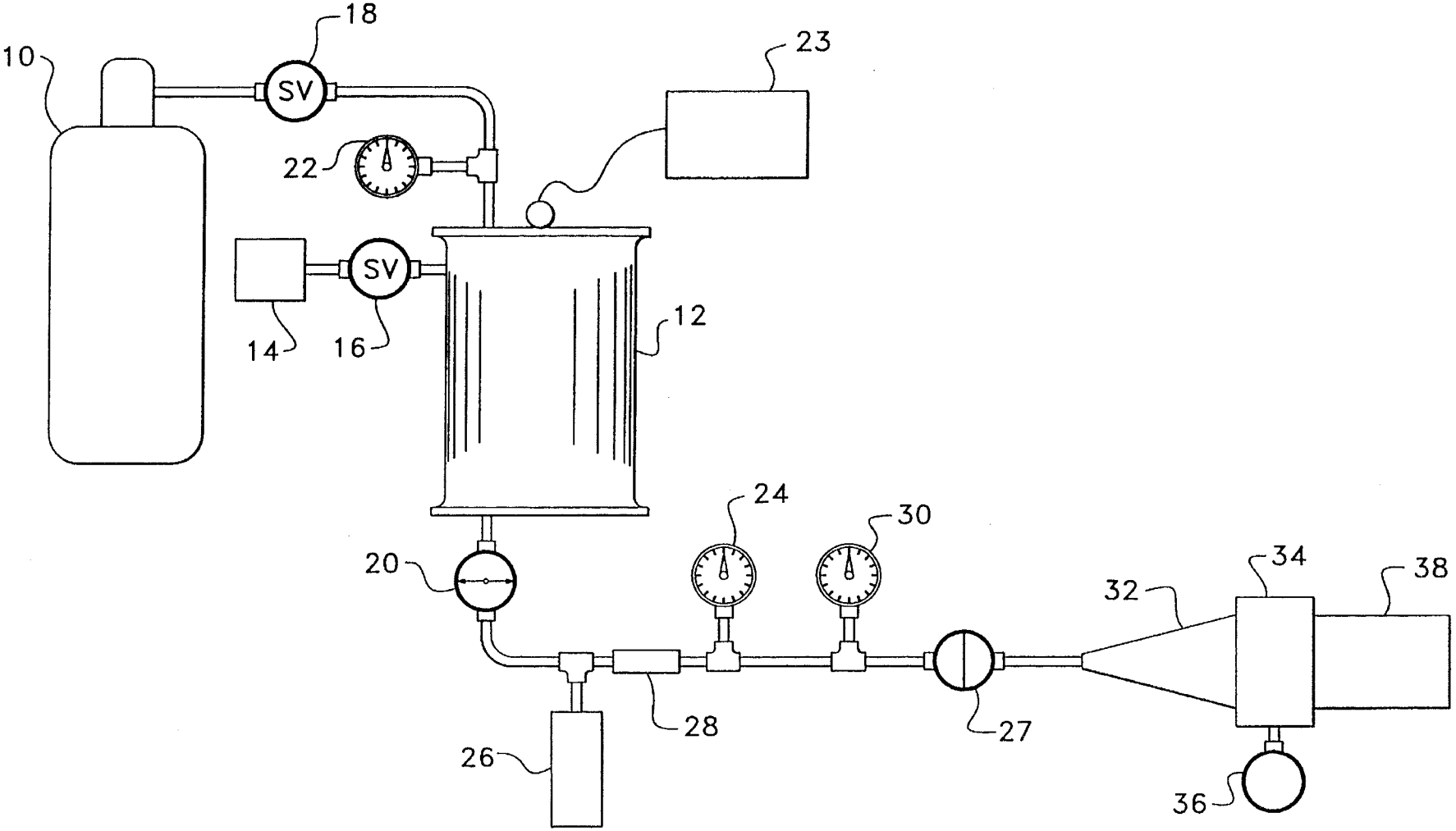
FIG. 1 shows schematic diagram of how the present invention is practiced in a pulsed MHD system.

FIG. 1 shows how the heater of the present invention is practiced in a pulsed MHD power system. High pressure gas, such as helium, is stored in one or more cylinders (10). Prior to heat up, the heater vessel (12) is evacuated with a vacuum pump (14). After evacuation a solenoid valve (16) cuts of the vacuum pump from the heater. The solenoid valve (18) is opened to fill the heater with gas to a pressure that is below the breaking pressure of the burst disc (20). After completion of the heatup of the electric power (23) is shutoff, and the heater vessel is filled to burst pressure. Either pressure gauge (22) or (24) detects the pressure change and sends it to a computer (not shown) that controls the hot flow test. A signal opens two solenoid valves (122) and (124) (FIG. 5) that control the cesium injection system (26) to be described latter. A second burst disc (27) initiates flow into the MHD generator channel (32). In other applications this channel could be an MHD accelerator or a wind tunnel. The computer turns on the pulsed MHD magnet of the MHD channel (32), if necessary, to coincide with the transit time of the peak gas pressure through the MHD channel. An annubar (28) measures the gas mass flow rate downstream of the heater, and thermocouples located in the gas stream (30) measure the gas temperature. The seeded gas flows through the MHD channel (32) and exits to the finned tube heat exchanger (34) which condenses the cesium and collects it in a vessel (36). The cooled helium gas enters the deflated balloon (38) and inflates it. After the test, the gas can be pumped out for reuse. The dimensions of this system and the test duration are dictated by the desired power output and pulse duration. At the end of the desired test time, the solenoid valve 18 is shut off and the gas flow ceases. For a small power output, such as 1 MW and for a pulse duration of a few tenths of one second, the gas can be supplied by a single cylinder of helium gas holding 240 standard cubit feet of gas.

Figure 2A:
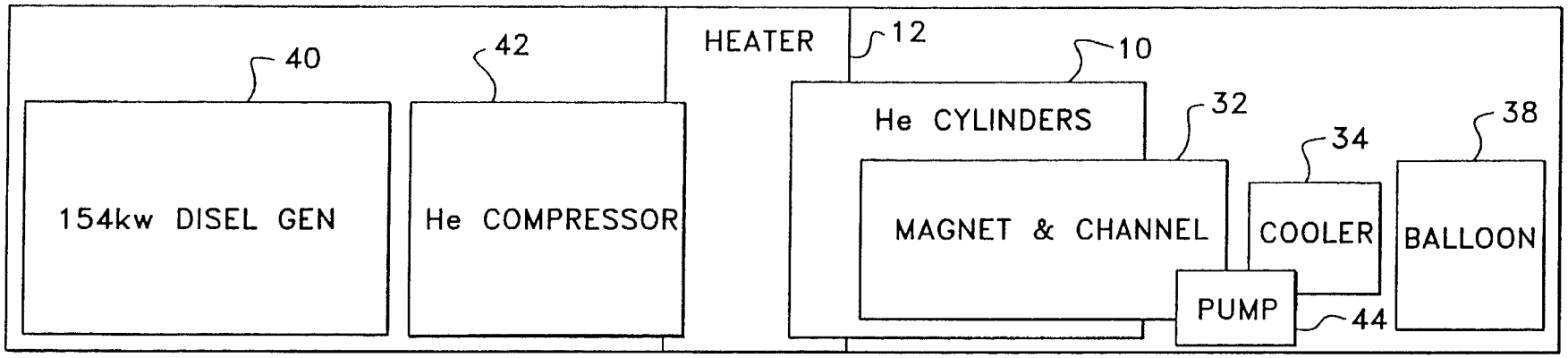
FIG. 2 shows a top view and side view in crossection and to scale of a schematic layout of a 15 MW 10 second electric output pulsed MHD system in which the present invention is practiced.
Figure 2B:
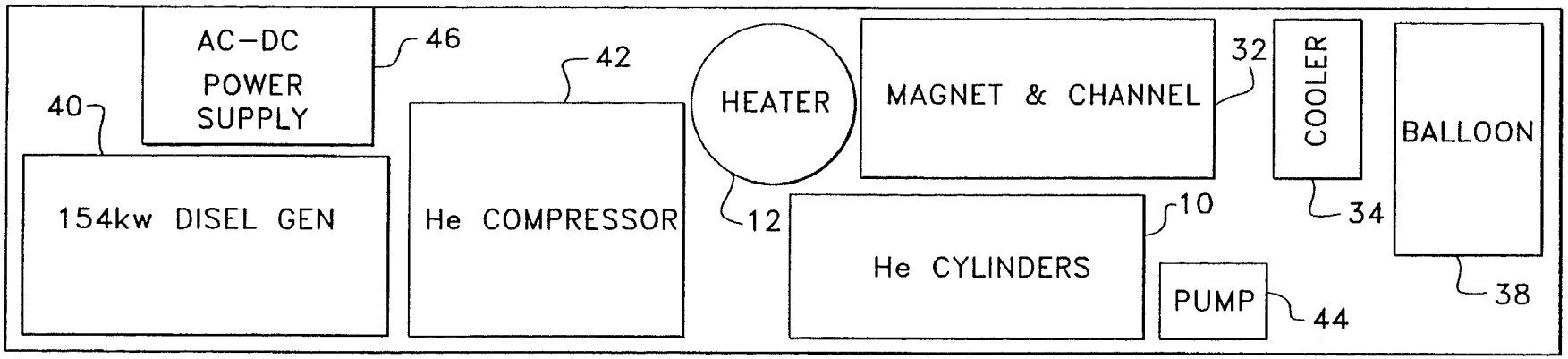

FIG. 2. shows how this invention can be practiced in a MHD power system that produces multi megawatts of power for multi second duration. The figure shows, to scale, the arrangement of all the major components required to operate the heater system to produce for 15 MW of electric power for 10 seconds. Helium is the test gas used for this example. For this pulse, the entire system is mounted on a platform that is 34 feet long, 8 feet wide, and about 8 feet high. The estimated weight and size of the components in the 15 MW MHD system are shown in Table 1. Referring to FIG. 2, the heater (12) is heated by a 154 kw diesel generator (40) for 10 hours on initial heatup, and for 4 hours on subsequent heatup after each 10 second pulse. Helium is stored in nine 3600 psi composite cylinders (10), and during power tests, it flows through the heater to the MHD channel (32), then to the cooler (34) and fills a balloon (38) that captures all the helium. After the test, a helium compressor (42) refills the He cylinders from the balloon in a period of several hours. Pump (44) is used to drive the cooling fluid through the condenser. The magnet for the MHD channel is powered by the diesel generator (40), which was disconnected from the heater (12) prior to the start of the helium gas flow, and its AC output voltage was switched to a AC-DC converter (46) which is connected to the MHD magnet.

Figure 3:
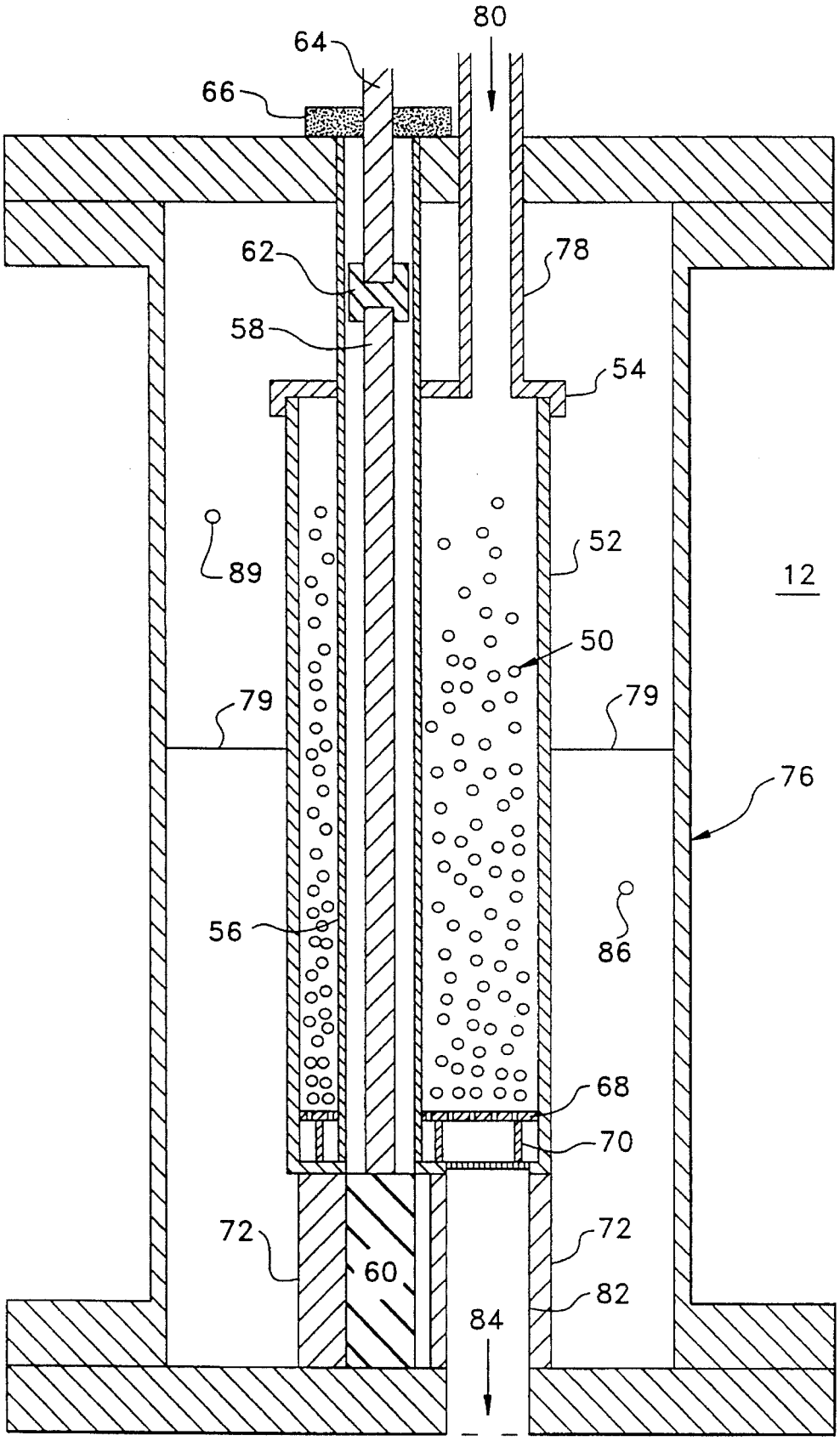
FIG. 3 is a cross-sectional schematic diagram in the vertical plane of the packed pebble bed heater in which the present invention is employed.

FIG. 3 shows a drawing of a cross-sectional view in the vertical plane of a packed bed heater (12) constructed in accordance with the present invention. For clarity the invention will be described in terms of the actual first heater that was constructed and tested to reduce the invention to practice. However, the basic principles can be used in heaters of different sizes and different flow durations. One-quarter inch diameter graphite spheres (50) are placed as a packed bed inside a graphite vessel (52) of 3.25 inch internal diameter, 4.25 inch external diameter, and 10 inch height. A graphite cap (54) is placed over the heater (52) to contain the pebbles, and the lower part of the cap is bonded with graphite cement to the heater. A ⅝" ID-¾" OD graphite tube (56) is placed inside the heater vessel. The 5/16" diameter electric heater rod (58) is placed inside this tube. The bottom of this rod touches a ⅝" diameter plug (60) which connects the rod to the electrical ground of the heater vessel, and the top of the heater rod is bonded to a graphite sleeve (62) whose other end covers the copper rod (64) of the electrical feed through (66) that provides the power to the rod. The outside of the feed through is connected to one secondary wire of a step down transformer (104) FIG. 4, while the other wire of the secondary is grounded. The pebbles rest on a perforated graphite plate 3.5" diameter, ¼ inch thick with 400 to 500 holes (68), which allows the downward flowing gas in the direction of gravity to exit the heater vessel. The plate rests on short ¼" D. graphite rods (70). The entire heater assembly rests on ¼" D or ⅜" D graphite columns (72) to minimize heat loss to the shell. Graphite rods (74) also support the heater vessel (52) laterally inside the steel shell (76) A graphite tube (78) of ¾" OD, ⅝" ID is placed on top of the heater for the gas inlet (80) and another tube (82) of 1.25" OD, 1" ID is placed at the bottom for the gas outlet (84). The entire heater assembly is surrounded by carbon fiber insulation (86), which maintains the steel shell (76) at a safe temperature during operation. The steel shell (76) is a cylinder of 10" D, ¼" wall thickness, and 16" height. It has blind flanges at the top and bottom for gas inlet and outlet and at the top for power inlet. The steel heater vessel shell (76) is designed to withstand the peak operating gas pressure.

If one heater graphite rod (58) has inadequate electric dissipation to heat the bed to a desired temperature, the power input can be doubled by placing an identical heater rod alongside the first one. In this case the secondary of the transformer (104) is connected to each of the graphite heater rods (58) (FIG. 4B), and the bottom ground is only used to provide an electric path from the bottom of one rod to the other.

The embodiment of the invention can also be practiced with ceramic material. However, due to their lower peak operating temperature and their greater brittleness, the peak operating pressure will be less than with graphite.

Figure 4A:
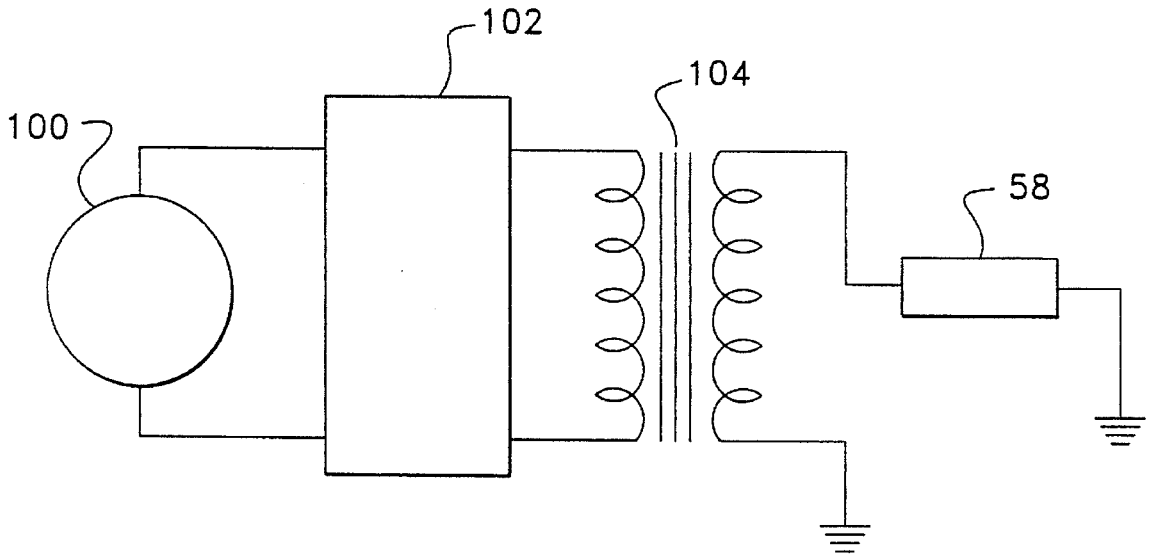
FIGS. 4A and 4B is schematic of two arrangements of the electric circuit for the heating elements in the heater.
Figure 4B:
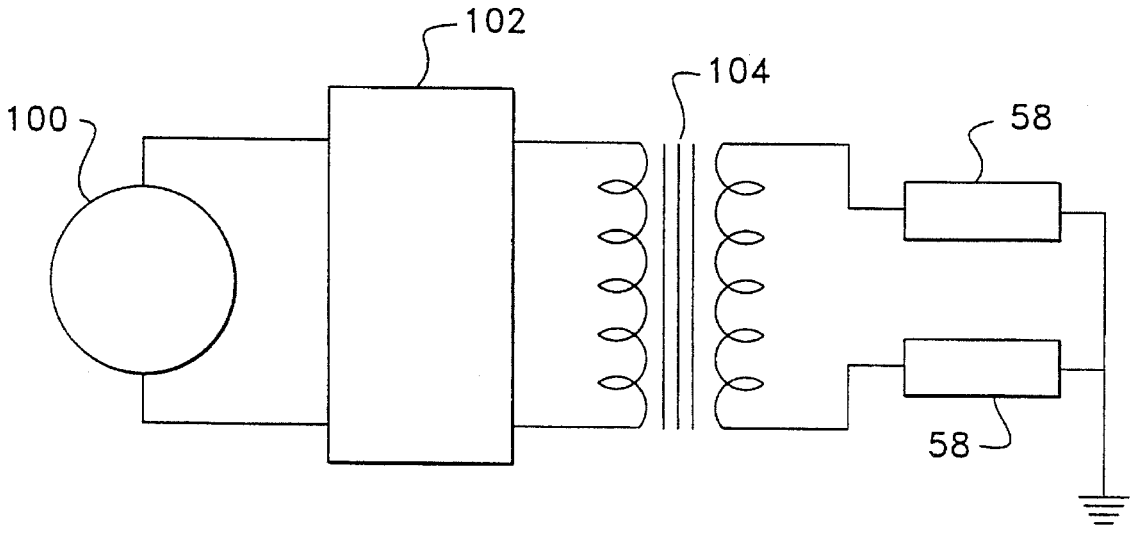

The amount of thermal insulation needed by the heater is determined by the rapidity of electric heatup of the heater. A long heatup cycle requires more insulation. Since the heater operates at the gas stagnation pressure plus pressure losses in the heater, a thick insulator yields a large and costly pressure vessel. Power is provided to the graphite heater rods as shown in FIGS. 4A and 4B. Typically, a 220 V or 440 V AC power source (100) is connected to a variable output, silicon controlled rectified (SCR) power supply (102). The SCR in turn is connected to a step down transformer (104) whose secondary is impedance matched to the graphite heating rod(s) (58). One or two rods equal in length to the length of the pebble bed are use. With one rod the other side of the transformer is grounded to the pressure vessel. With two rods, the transformer secondary is connected to each feedthrough on the heater vessel. The bottom of the rods are connected to each other through ground potential. For the 1 MJ system tested, the SCR supply was rated at 0 to 10 kW. With a nominal 1 hour heatup cycle, 3 inch thick cylindrical insulation around the heater was required. This yielded 10" ID×16" long pressure vessel as described for FIG. 3.

Due to the extremely high heater temperatures, only carbon insulation was suitable for the heater. For this purpose, graphite powder was used. While it provided the desired thermal insulation, its use caused major operational difficulties with the gas handling and heater performance due to dust entrainment. Therefore to practice this invention graphite felt cloth (86) is used and this was found to produce little dust entrainment in the heater used to reduce this invention to practice.

Figure 5:
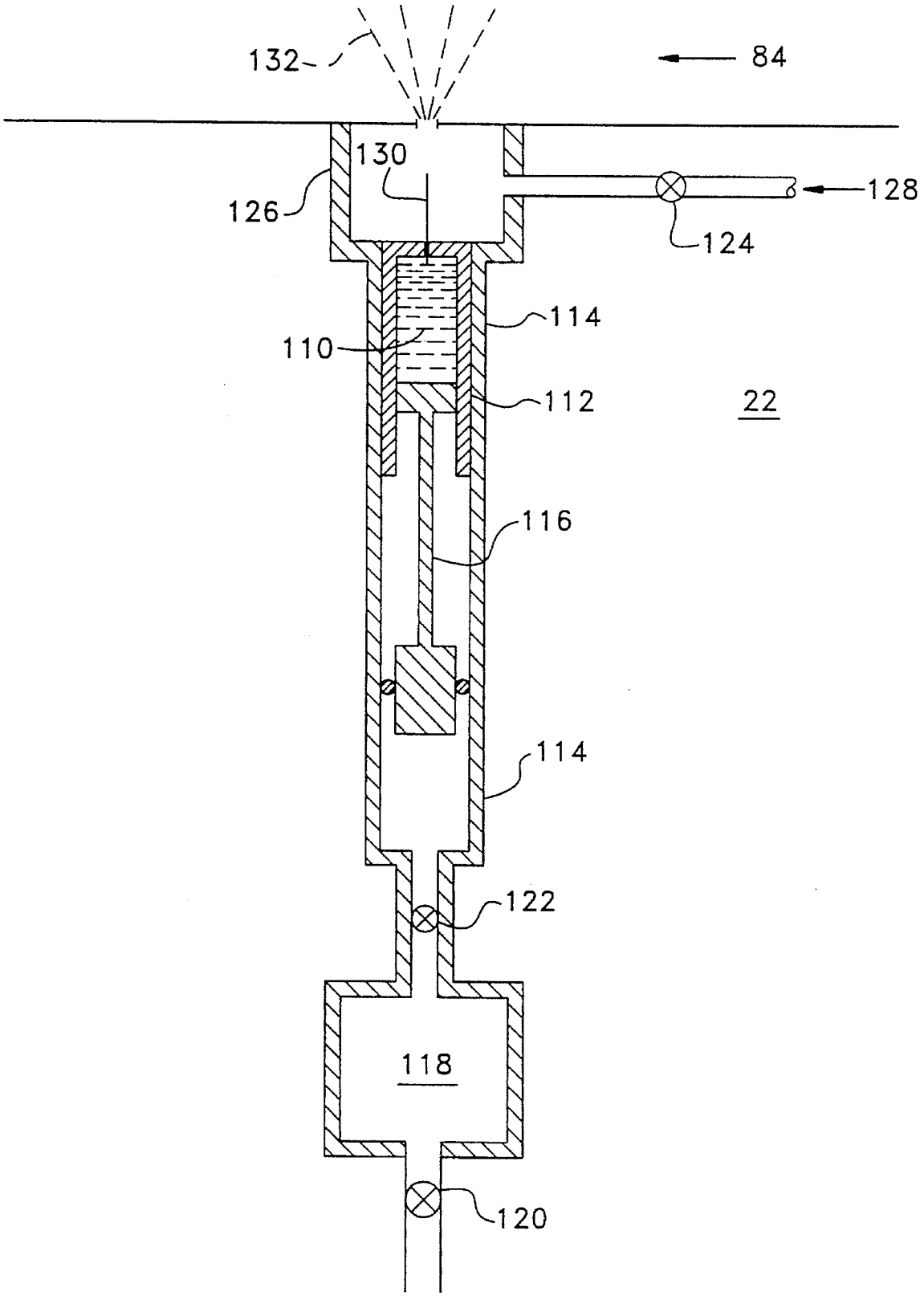
FIG. 5 shows a cross-sectional schematic diagram of the cesium injection system in which the present invention is employed.

FIG. 5 shows the cesium injection system (22). Liquid cesium (110) is sucked into a syringe (112) in a nitrogen filled dry box. The syringe and plunger (116) for injecting cesium into the hot helium gas stream are placed in a steel tube (114) which serves as a guide for the plunger. Prior to the test, a cylinder (118) is filled though valve (120) to about 400 psi for the 0.1 second pulse MHD system. When gas flow starts through the heater, solenoid valves (122) and (124) of the injection system are opened simultaneously. The former allows the high pressure gas to drive the plunger into the syringe, while the latter allows cold helium gas (128) flow to enter the gas atomizer (126). The cold helium (128) which is at a pressure greater than that of the hot gas flow exiting from the heater (84), atomizes the liquid cesium emerging from the 0.025" ID hypodermic needle (130) and forces the 35 micrometer size droplets (132) into the hot helium gas stream. The amount of cesium is sufficient to perform a test of several 1/10 second duration, which is 1 gram of cesium for the present example.

Figure 6:
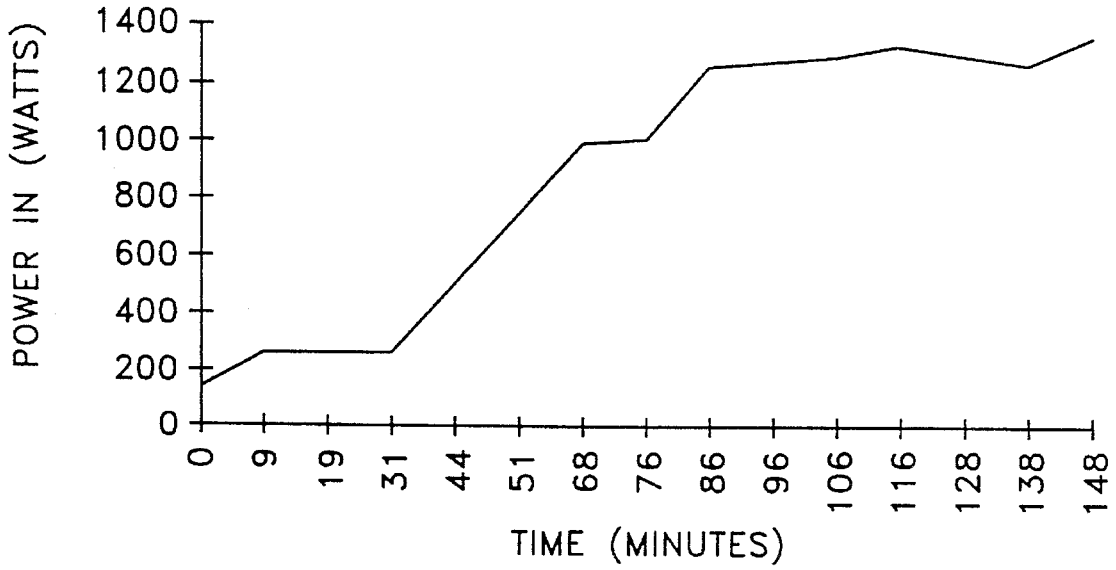
FIG. 6 shows the electric power input to the 1 MJ output storage heater that was measured in one of the operational tests.
Figure 7:
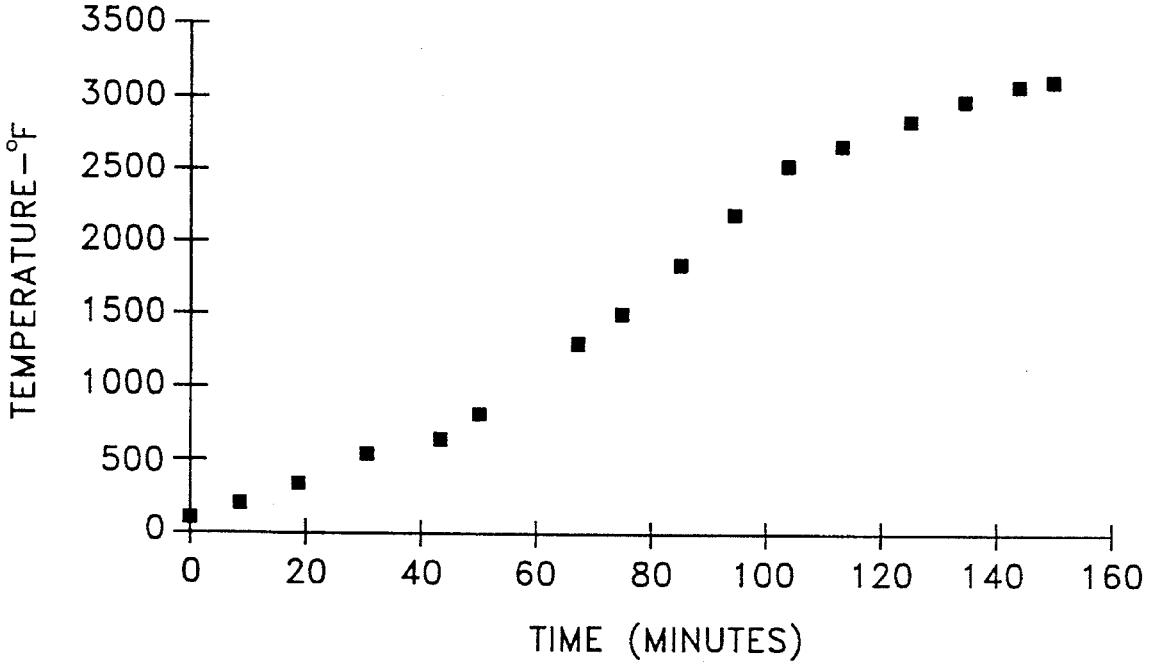
FIG. 7 shows the pebble bed heater temperature that was computed from thermocouples located inside the insulating section of the heater for the test shown in FIG. 6

FIG. 6 shows the measured electric power input to the graphite heater rods (58) versus time. The figure shows the preferred procedure, namely, a gradual heatup to prevent failure of the heating rod. Failure can occur with a rapid heatup cycle. FIG. 7 shows the temperature in the graphite pebble bed (52) as computed from the thermocouple readings inside the insulation. As the thermal conductivity of the graphite is about 100 times that of the insulation, the temperature across the pebble bed (52) is essentially uniform. As shown in FIG. 7, a peak temperature of 1700 C. was deduced after 150 minutes, at which time, the gas pulse was initiated. As can be seen, the temperature decrease from the 0.1 to 0.2 second gas pulse at the 150 minute marker was negligible.

Figure 8:
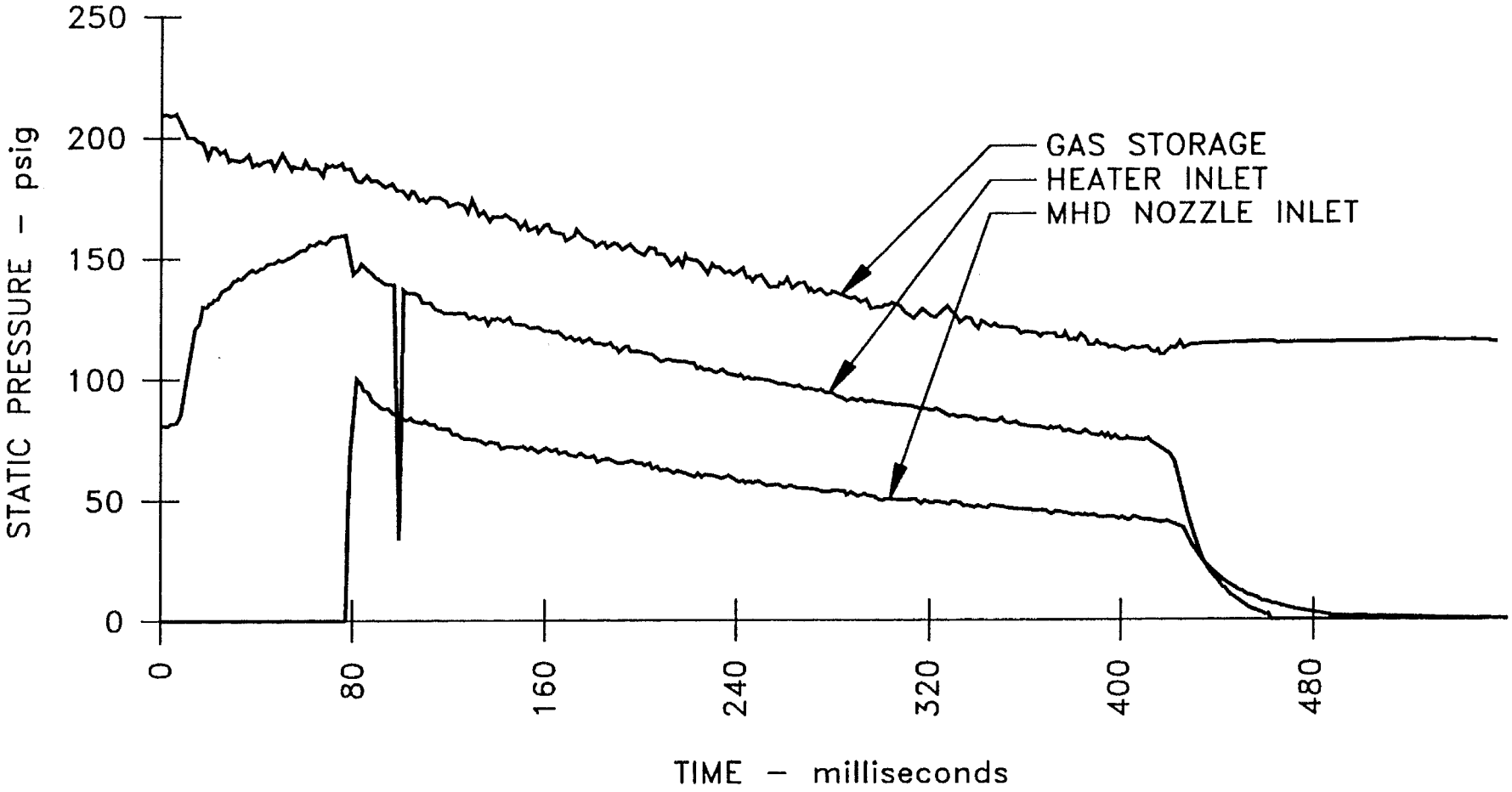
FIG. 8 shows the pressure pulse measured upstream and downstream of the heater during the above test

FIG. 8 shows the gas pressure measured at the gas storage cylinder (10), (as shown in the top curve), at the heater vessel inlet (22), (middle curve) and the MHD nozzle inlet (i.e. heater outlet) (24) (bottom curve). The usable test pulse was about 300 milliseconds and one notes the relatively high pressure losses in each segment of the system. This is acceptable for practicing the present invention. It is not acceptable in the applications pursued by the prior art in the packed bed heat exchanger. In the latter case, the pressure losses would be far too high.

Figure 9:
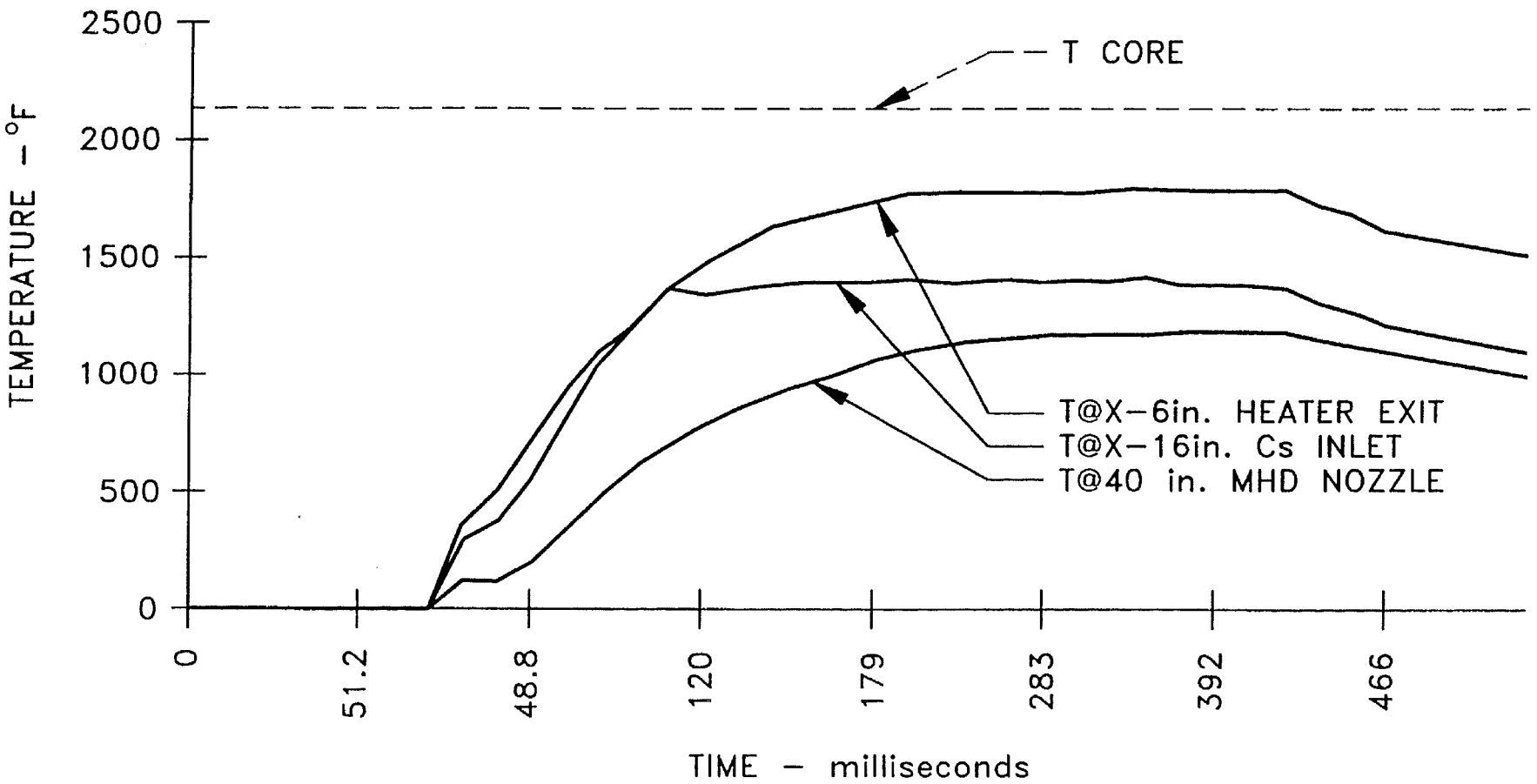
FIG. 9 shows measured temperatures at various locations in the heater during one test.

FIG. 9. shows the gas temperatures derived from thermocouple measurements at three locations downstream from the heater exit. Also shown is the bed temperature (top curve) (52). The measurements were obtained in the heater (12) used to reduce this invention to practice. Note the substantial temperature loss from the bed to the temperature measured 6 inches from the heater outlet. At 16 inches from the outlet, (3rd curve from top) additional losses are measured. Finally, at 40 inches almost half the temperature is lost. This result shows the need for minimizing the spacing between the heater outlet and the test MHD channel.

While the present invention has been described with respect to specific embodiments, it may be embodied in other specific forms without departing from its spirit or essential attributes. Accordingly, reference should be made to the appended claims, rather than the foregoing specifications and accompanying drawings for an indication of the scope of the invention.

I claim:

1. A compact packed bed heating system adapted for producing a greater than 1700° C. temperature gas flow pulse in a channel at a preselected high gas pressure for use in a pulsed nonequilibrium power systems with the minimum pulse duration determined by the gas flow and power components turn on time and the maximum pulse duration determined by the thermal energy stored in the packed bed, with said heating system comprising:

(a) a heater vessel having top and bottom ends;

(b) a bed of spherical pebbles packed inside said vessel and contained within a cylindrical vessel of similar material as the pebbles;

(c) an electrical heater element inserted through said packed bed of pebbles and electrically and physically isolated from said pebbles, for heating all said pebbles to approximately the same preselected temperature;

(d) a high pressure test gas storage means, and a means for pre-filling said heater vessel prior to initiating a gas pulse;

(e) flow connecting means for connecting said test gas storage means to said heater vessel so that the test gas flows into said top end of said heater vessel downwards and out through said bottom end of said heater vessel.

2. The heating system of claim 1 including vacuum means for evacuating said heater vessel and prefilling said heater vessel prior to heating and initiating test gas flow therethrough.

3. The heating system of claim 1 wherein said heater vessel is surrounded with fiber or filament wound insulation designed to minimize both heat loss and electric power input during heatup and heater vessel weight.

4. The heater system of claim 1 wherein said heater vessel and test gas outlet therefrom are designed to produce a pressure drop across the heater vessel that is less than the allowable structural stress in said heater vessel that contains said spherical pebbles, with said stress reduction achieved in part by prefilling the heater vessel with the test gas to somewhat less than operating pressure.

5. The heating system of claim 1 including a a very rapidly opening valve, located downstream of the test gas outlet from the heater vessel, and with said valve set to open at a pressure that is slightly higher than the prefilled gas pressure.

6. The heating system of claim 1 wherein said electrical heating rods are connected to a solid state power supply including impedance matching in a step down transformer designed to allow a wide range of thermal power input to said heater without excessive mechanical stress to said heating element resulting from rapid heatup.

7. The heating system of claim 1 including computer control for providing proper sequence of introducing pulsed test gas flow through the heated spheres in said heater vessel, followed by injection of seed metal vapor, ignition of magnet, production of MHD power pulse, and stopping said gas flow at termination of power pulse.

8. The heating system of claim 1 including a seeding system for introducing a fine mist of particles of alkali metal liquid droplets into the heated test gas flowing out of said heater vessel.

9. The heating system of claim 8 wherein said seeding system includes hypodermic needles and a gas atomizing device to produce said particles of sufficient small size to completely vaporize in a time that is very short compared to the gas transit time to the MHD channel entrance.

10. The heating system of claim 1 where said test gas is selected from the group comprising: noble gases, hydrogen, nitrogen, and mixtures of said gases, and diatomic molecular gases.

11. A method for producing a high temperature test gas at a preselected pressure for use in a pulsed nonequilibrium power system, the method including the steps of:

(a) packing an upright heater having top and bottom ends with spherical pebbles and placing said pebbles in a cylindrical container of like material;

(b) connecting the top end of the heater vessel to a high pressure source of test gas;

(c) heating the spherical pebbles using one or more electrical heating elements inserted through the spherical pebble packing and physically and electrically isolated therefrom;

(d) selectively introducing test gas into the top end of the heater vessel for a downward test gas flow through the heater vessel to an outlet at the bottom of the heater vessel for preselected short periods.

12. The method of claim 11 including a step for prefilling said vessel with test gas before starting the heating step.

13. A compact, portable, pulsed non-equilibrium magnetohydrodynamic power system comprising (a) a high temperature test gas using unit whose high gas pressure inlet is connected to the test gas outlet of a packed bed heating assembly, and (b) a packed bed heating assembly containing electric heating elements physically and electrically isolated from the pebbles for heating the test gas to be used in said unit, said heating assembly including a high pressure gas storage vessel operatively connected to the top of an upright heater vessel and means for passing test gas from the gas storage vessel through the top to the bottom of the heater vessel for downward test gas flow.

14. The system of claim 13 including recovery and reuse means operatively connected to, and downstream of said test gas using unit for collecting spent test gas for subsequent reuse.

15. The system of claim 14 including a compact test vapor condenser operatively connected to the downstream end of said test gas using unit.

16. The system of claim 15 including test gas holding balloons operatively connected to the downstream end of said test vapor condenser and a test gas compression pump operatively connected between said balloons and said high pressure gas storage vessel for pumping the low pressure gas from the balloons to the high pressure gas storage vessel to allow multiple reuse of said test gas.

17. The system of claim 15 including a filter bag operatively connected to the downstream outlet of said test vapor condenser to recover dust particles and droplets prior to exhausting the test gas to the atmosphere where test gas reuse is not necessary.

* * * * *